US008425761B2

(12) United States Patent
Wright et al.

(10) Patent No.: US 8,425,761 B2
(45) **Date of Patent: *Apr. 23, 2013**

(54) NON-HIGH SOLVENCY DISPERSIVE POWER (NON-HSDP) CRUDE OIL WITH INCREASED FOULING MITIGATION AND ON-LINE CLEANING EFFECTS

(75) Inventors: Chris A. Wright, Bordentown, NJ (US); Glen B. Brons, Phillipsburg, NJ (US); Sharon Feiller, Allentown, PA (US); George A. Lutz, Brick, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 420 days.

This patent is subject to a terminal disclaimer.

(21) Appl. No.: 12/314,453

(22) Filed: Dec. 11, 2008

(65) Prior Publication Data

US 2010/0147333 A1 Jun. 17, 2010

(51) Int. Cl.
*B01J 19/00* (2006.01)

(52) U.S. Cl.
USPC ..... 208/48 AA; 208/47; 208/48 R; 208/14

(58) Field of Classification Search ..... 208/47, 208/48 R, 48 AA
See application file for complete search history.

(56) References Cited

U.S. PATENT DOCUMENTS

| | | | |
|---|---|---|---|
| 2,276,155 | A | 3/1942 | Carr |
| 3,321,395 | A | 5/1967 | Paterson |
| 3,830,732 | A | 8/1974 | Gatsis |
| 4,515,685 | A | 5/1985 | Yeh |
| 4,655,903 | A | 4/1987 | Rahbe et al. |
| 4,671,103 | A | 6/1987 | Dickakian |
| 4,686,028 | A | 8/1987 | Van Driesen et al. |
| 4,853,337 | A | 8/1989 | Dickakian |
| 5,863,415 | A | 1/1999 | Zetlmeisl |
| 5,871,634 | A | 2/1999 | Wiehe |
| 5,997,723 | A | 12/1999 | Wiehe |
| 6,048,904 | A | 4/2000 | Wiehe et al. |
| 6,355,159 | B1 | 3/2002 | Myers |
| 6,706,669 | B2 | 3/2004 | Sartori et al. |
| 2004/0072361 | A1 | 4/2004 | Varadaraj et al. |
| 2004/0121472 | A1 | 6/2004 | Nemana et al. |
| 2006/0021907 | A1 | 2/2006 | Varadaraj et al. |

(Continued)

FOREIGN PATENT DOCUMENTS

| | | | |
|---|---|---|---|
| EP | 0125709 | B1 | 2/1989 |
| WO | 2008024309 | A2 | 2/2008 |
| WO | 2008024323 | A2 | 2/2008 |
| WO | 2009085062 | A1 | 7/2009 |

OTHER PUBLICATIONS

Written Opinion, PCT Appl. No. PCT/US2009/006477, dated Mar. 24, 2010, 6 pages.
Search Report, PCT Appl. No. PCT/US2009/006477, dated Mar. 24, 2010, 4 pages.

(Continued)

*Primary Examiner* — Brian McCaig
(74) *Attorney, Agent, or Firm* — Glenn T. Barrett

(57) ABSTRACT

Non-high solvency dispersive power (non-HSDP) crude oil with increased fouling mitigation and on-line cleaning effects includes a base non-HSDP crude oil and an effective amount of resins isolated from a high solvency dispersive power (HSDP) crude oil, and method of making same. Also, methods of using such non-HSDP crude oil for on-line cleaning of a fouled crude oil refinery component, for reducing fouling in a crude oil refinery component, and in a system capable of experiencing fouling conditions associated with particulate or asphaltene fouling.

32 Claims, 2 Drawing Sheets

$\Delta T = T_{OUTLET} - T_{OUTLET}$
;MEASURES HEAT TRANSFER OF FOULANT LAYER

U.S. PATENT DOCUMENTS

| | | | |
|---|---|---|---|
| 2006/0042661 | A1 | 3/2006 | Meyer et al. |
| 2006/0219266 | A1 | 10/2006 | Meyer |
| 2007/0023323 | A1 | 2/2007 | Van Den Berg et al. |
| 2008/0041762 | A1 | 2/2008 | Brons et al. |

OTHER PUBLICATIONS

Carnahan, Norman F, et al. "Properties of Resins Extracted from Boscan Crude Oil and Their Effect on the Stability of Asphaltenes in Boscan and Hamaca Crude Oils", Energy & Fuels, Jan. 1999, vol. 13, No. 2, pp. 309-314.

Goual, Lamia, et al. "Effect of Resins and DBSA on Asphaltene Precipitation from Petroleum Fluids", AIChE Journal, Feb. 2004, vol. 50, No. 2, pp. 470-479.

Leon, O, et al. "Asphaltenes: Structural Characterization, Self-Association, and Stability Behavior", Energy & Fuels, Jan. 2000, vol. 14, No. 1, pp. 6-10.

Gary, J.H. et al. (2007), Petroleum Refining Technology and Economics, CRS Press, 465 pgs.

Speight, J.G. (1999). The Chemistry and Technology of Petroleum, 3rd ed., Marcel Dekker, 918 pgs.

Al-Sahhaf, T.A. et al. (2002). Fluid Phase Equilibria, 194-197, pp. 1045-1057.

Rahimi, P.M. et al. (2004). Prepr. Pap.-Am. Chem. Soc. Div. Pet. Chem., 49(2), pp. 147-149.

PCT/US2009/006254, PCT International Search Report, Form PCT/ISA/210, dated Dec. 28, 2010, 6 pgs.

PCT/US2009/006254, PCT Written Opinion of the International Searching Authority, Form PCT/ISA/237, dated Dec. 28, 2010, 9 pgs.

Carnahan, Norman F., "Properties of Resins Extracted FRO Boscan Crude Oil and Their Effect on the Stability of Asphaltenes in Boscan and Hamaca Crude Oils", Energy & Fuels, 1999, pp. 309-314, vol. 980218.

PCT International Search Report, PCT/US2009/053371, Form PCT/ISA/210, mailed Nov. 27, 2009, 4pgs.

PCT Written Opinion of the ISA, PCT/US2009/053371, Form PCT/ISA/237, mailed Nov. 27, 2009, 7 pgs.

The Oil Compatibility Model and Crude Oil Incompatibility, Wiehe and Kennedy, Energy & Fuels 2000, vol. 14, pp. 56-59, published Dec. 14, 1999.

Wiehe, Irwin A., "Fouling of Nearly Icompatible Oils", American Chemical Society, Journal, Energy & Fuels (2001), 15 (5), 1057-1058.

Wiehe, Irwin A., "Prevention of Fouling by Incompatible Crudes With the [Crude] Oil Compatibility Model", ALChE 1999 Spring National Meeting (Houston Mar. 14-18, 1999) Preprint N. 9.

International Search Report, PCT/US2009/053374, mailed Nov. 20, 2009.

Written Opinion, PCT/US2009/053374, mailed Nov. 20, 2009.

International Search Report, PCT/US2007018403, mailed Sep. 25, 2008.

Written Report, PCT/US2007/018403, mailed Sep. 25, 2008.

Carbognani, et al.: "Complex Nature of Separated Solid Phases from Crude Oils", Energy & Fuels, vol. 13, No. 2, Feb. 13, 1999.

Ali et al.: "Structural Representation of Asphaltene GPC Fractions Derived from Kuwaiti Residual Oils", Energy & Fuels, vol. 20, No. 1, Nov. 24, 2005.

International Search Report, PCT/US2008/009411, mailed Feb. 18, 2009.

Written Opinion, PCT/US2008/009411, mailed Feb. 18, 2009.

Deasphalted Oil: A Natural Asphaltene Solvent, Jamaluddin et al., SPE Production & Facilities, Aug. 1996, p. 161-p. 165.

The Effectiveness of Deashpalted Oil in the Stability of Visbroken Athabasca Bitumen, Rahimi et al., Prepr. Pap.-AM. Chem. Soc., Div. Pet. Chem., 2004, p. 147-p. 149.

Retardation of Asphaltene Precipitation by Addition of Toluene, Resins, Deasphalted Oil and Surfactants, Ai-Sahhaf et al., Fluid Phase Equilibria 194-197, 2002, p. 1045-p. 1057.

$\Delta T = T_{OUTLET} - T_{OUTLET}$

;MEASURES HEAT TRANSFER OF FOULANT LAYER

NON-HIGH SOLVENCY DISPERSIVE POWER (NON-HSDP) CRUDE OIL WITH INCREASED FOULING MITIGATION AND ON-LINE CLEANING EFFECTS

CROSS REFERENCE TO RELATED APPLICATIONS

This application relates to U.S. patent application Ser. No. 11/506,901 entitled "Method of Blending High TAN and High $S_{BN}$ Crude Oils and Method of Reducing Particulate Induced Whole Crude Oil Fouling and Asphaltene Induced Whole Crude Oil Fouling" filed Aug. 21, 2006 (U.S. Pat. No. 7,833,407); U.S. patent application Ser. No. 12/222,760, entitled "High-Solvency-Dispersive-Power (HSDP) Crude Oil Blending For Fouling Mitigation And On-line Cleaning" filed Aug. 15, 2008 (U.S. Pat. No. 7,837,855); U.S. patent application Ser. No. 12/292,648, entitled "Methods Of Isolating And Using Components From A High Solvency Dispersive Power (HSDP) Crude Oil," filed Nov. 24, 2008; and U.S. patent application Ser. No. 12/219,180, entitled "Method For Reducing Oil Fouling In Heat Transfer Equipment," filed Jul. 17, 2008 (U.S. Pat. No. 8,062,504), which relates to and claims priority from U.S. Provisional Patent Application No. 60/935,321, entitled "Method for Reducing Oil Fouling in Heat Transfer Equipment," filed Aug. 6, 2007, each of which is incorporated by reference in its entirety.

FIELD OF THE INVENTION

The present invention relates to processing of whole crude oils, blends and fractions in refineries and petrochemical plants and to the reduction of particulate induced crude oil fouling and asphaltene induced crude oil fouling. In particular, the present invention relates to the addition of High Solvency Dispersive Power (HSDP) crude oil resins to non-HSDP crude oils to increase the fouling mitigation and on-line cleaning effects of the non-HSDP crude oil.

BACKGROUND OF THE INVENTION

Fouling is generally defined as the accumulation of unwanted materials on the surfaces of processing equipment. In petroleum processing, fouling is the accumulation of unwanted hydrocarbon-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers. Second, as deposition occurs, the cross-sectional area is reduced, which causes an increase in pressure drop across the apparatus and creates inefficient pressure and flow in the heat exchanger.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall. For example, the inventors have shown that a low-sulfur, low asphaltene (LSLA) crude oil and a high-sulfur, high asphaltene (HSHA) crude blend are subject to a significant increase in fouling when in the presence of iron oxide (rust) particulates.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Another common cause of rapid fouling is attributed to the presence of salts and particulates. Salts/particulates can precipitate from the crude oils and adhere to the hot surfaces of the heat exchanger. Inorganic contaminants play both an initiating and promoting role in the fouling of whole crude oils and blends. Iron oxide, iron sulfide, calcium carbonate, silica, sodium and calcium chlorides have all been found to be attached directly to the surface of fouled heater rods and throughout the coke deposit.

Prolonged exposure to such surface temperatures, especially in the late-train exchanger, allows for the thermal degradation of the organics and asphaltenes to coke. The coke then acts as an insulator and is responsible for heat transfer efficiency losses in the heat exchanger by preventing the surface from heating the oil passing through the unit. Salts, sediment and particulates have been shown to play a major role in the fouling of pre-heat train heat exchangers, furnaces and other downstream units. Desalter units are still the only opportunity refineries have to remove such contaminants and inefficiencies often result from the carryover of such materials with the crude oil feeds.

Blending of oils in refineries is common, but certain blends are incompatible and cause precipitation of asphaltenes that can rapidly foul process equipment. Improper mixing of crude oils can produce asphaltenic sediment that is known to reduce heat transfer efficiency. Although most blends of unprocessed crude oils are not potentially incompatible, once an incompatible blend is obtained, the rapid fouling and coking that results usually requires shutting down the refining process in a short time. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils, blends and fractions in pre-heat train exchangers.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

The need exists to be able to prevent the precipitatation/adherance of particulates and asphaltenes from the heated surfaces before the particulates can promote fouling and the asphaltenes become thermally degraded or coked. The coking mechanism requires both temperature and time. The time factor can be greatly reduced by keeping the particulates away from the surface and by keeping the asphaltenes in solution. Such reduction and/or elimination of fouling will lead to increased run lengths (less cleaning), improved performance and energy efficiency while also reducing the need for costly fouling mitigation options.

Some refineries and crude schedulers currently follow blending guidelines to minimize asphaltene precipitation and the resultant fouling of pre-heat train equipment. Such guidelines suggest blending crude oils to achieve a certain relationship between the solubility blending number ($S_{BN}$) and insolubility number ($I_N$) of the blend. The $S_{BN}$ is a parameter relating to the compatibility of an oil with different proportions of a model solvent mixture, such as toluene/n-heptane. The $S_{BN}$ is related to the $I_N$, which is determined in a similar manner, as described in U.S. Pat. No. 5,871,634, which is incorporated herein by reference. Some blending guidelines suggest a $S_{BN}/I_N$ blend ratio >1.3 and a delta ($S_{BN}-I_N$)>10 to minimize asphaltene precipitation and fouling. However, these blends are designed for use as a passive approach to minimizing asphaltene precipitation.

Attempts have been made to improve the method of blending two or more petroleum oils that are potentially incompatible while maintaining compatibility to prevent the fouling and coking of refinery equipment. U.S. Pat. No. 5,871,634 discloses a method of blending that includes determining the insolubility number ($I_N$) for each feedstream and determining the solubility blending number ($S_{BN}$) for each stream and combining the feedstreams such that the $S_{BN}$ of the mixture is greater than the In of any component of the mix. In another method, U.S. Pat. No. 5,997,723 uses a blending method in which petroleum oils are combined in certain proportions in order to keep the $S_{BN}$ of the mixture higher than 1.4 times the $I_N$ of any oil in the mixture.

As described more fully in co-pending U.S. patent application Ser. No. 11/506,901, the inventors have found that feeding a blend of a base crude oil and a predetermined amount of a high solvency dispersive power (HSDP) crude oil, having a total acid number (TAN) of at least 0.3 and a solubility blending number ($S_{BN}$) of at least 95, will decrease fouling associated with asphaltenes and particulate induced/promoted fouling.

However, of the hundreds of crude oils produced worldwide, only a small number have been identified that meet the current criteria of a HSDP crude oil, which requires a total acid number (TAN) of at least 0.3 and a solubility blending number ($S_{BN}$) of at least 95. Therefore, there is a continued need for developing alternative approaches to increase the fouling mitigation and online-cleaning effects of non-HSDP or "near-HSDP" crude oils. Such an approach to improvement of non-HSDP or "near-HSDP" would increase the number of options available to refineries for both fouling mitigation and on-line cleaning effects, which would allow energy and maintenance cost savings.

SUMMARY OF THE INVENTION

According to one aspect of the present invention, a method of making a non-high solvency dispersive power (non-HSDP) crude oil with increased fouling mitigation and on-line cleaning effects is provided. The method includes providing a non-HSDP crude oil; providing resins isolated from a high solvency dispersive power (HSDP) crude oil; and blending the non-HSDP crude oil and an effective amount of the resins to form a blended crude oil. The non-HSDP crude oil preferably has a solubility blending number ($S_{BN}$) less than about 90, and more preferably between about 55 and about 75. The effective amount of resins is preferably at least about 50 parts per million by weight (wppm), and more preferably between about 50 and 1000 parts per million by weight (wppm).

According to another aspect of the present invention, a non-high solvency dispersive power (non-HSDP) crude oil with increased fouling mitigation and on-line cleaning effects includes a base non-HSDP crude oil and an effective amount of resins isolated from a high solvency dispersive power (HSDP) crude oil.

According to another aspect of the present invention a system capable of experiencing fouling conditions associated with particulate or asphaltene fouling is provided. The system includes at least one crude oil refinery component and a blend in fluid communication with the at least one crude oil refinery component. The blend includes a base crude oil and a non-high solvency dispersive power (non-HSDP) crude oil with increased fouling mitigation and on-line cleaning effects. The non-HSDP crude oil with increased fouling mitigation and on-line cleaning effects includes a non-HSDP crude oil and an effective amount of resins isolated from a high solvency dispersive power (HSDP) crude oil. The base crude oil can be one of a whole crude oil or a blend of at least two crude oils. The crude oil refinery component can be, among other things, a heat exchanger, furnace, distillation column, scrubber, reactor, liquid-jacketed tank, pipestill, coker, or a visbreaker.

According to another aspect of the present invention, a method for on-line cleaning of a fouled crude oil refinery component is provided. The method includes operating a fouled crude oil refinery component and feeding a blended crude oil to the fouled crude oil refinery component. The blended crude oil includes a base crude oil and a non-high solvency dispersive power (non-HSDP) crude oil with increased fouling mitigation and on-line cleaning effects. The non-HSDP crude oil with increased fouling mitigation and on-line cleaning effects includes a non-HSDP crude oil and an effective amount of resins isolated from a high solvency dispersive power (HSDP) crude oil.

According to another aspect of the present invention, a method for reducing fouling in a crude oil refinery component is provided. The method includes providing a base crude oil; providing a non-high solvency dispersive power (non-HSDP) crude oil with increased fouling mitigation and on-line cleaning effects; blending the base crude oil with the non-HSDP crude oil with increased fouling mitigation and on-line cleaning effects to create a blended crude oil; and feeding the blended crude oil to a crude oil refinery component. The non-HSDP crude oil with increased fouling mitigation and on-line cleaning effects includes a non-HSDP crude oil and an effective amount of resins isolated from a high solvency dispersive power (HSDP) crude oil.

These and other features of the present invention will become apparent from the following detailed description of preferred embodiments which, taken in conjunction with the accompanying drawings, illustrate by way of example the principles of the present invention.

BRIEF DESCRIPTION OF THE DRAWINGS

The invention will now be described in conjunction with the accompanying drawings in which.

In the drawings, like reference numerals indicate corresponding parts in the different figures.

Figure 1:
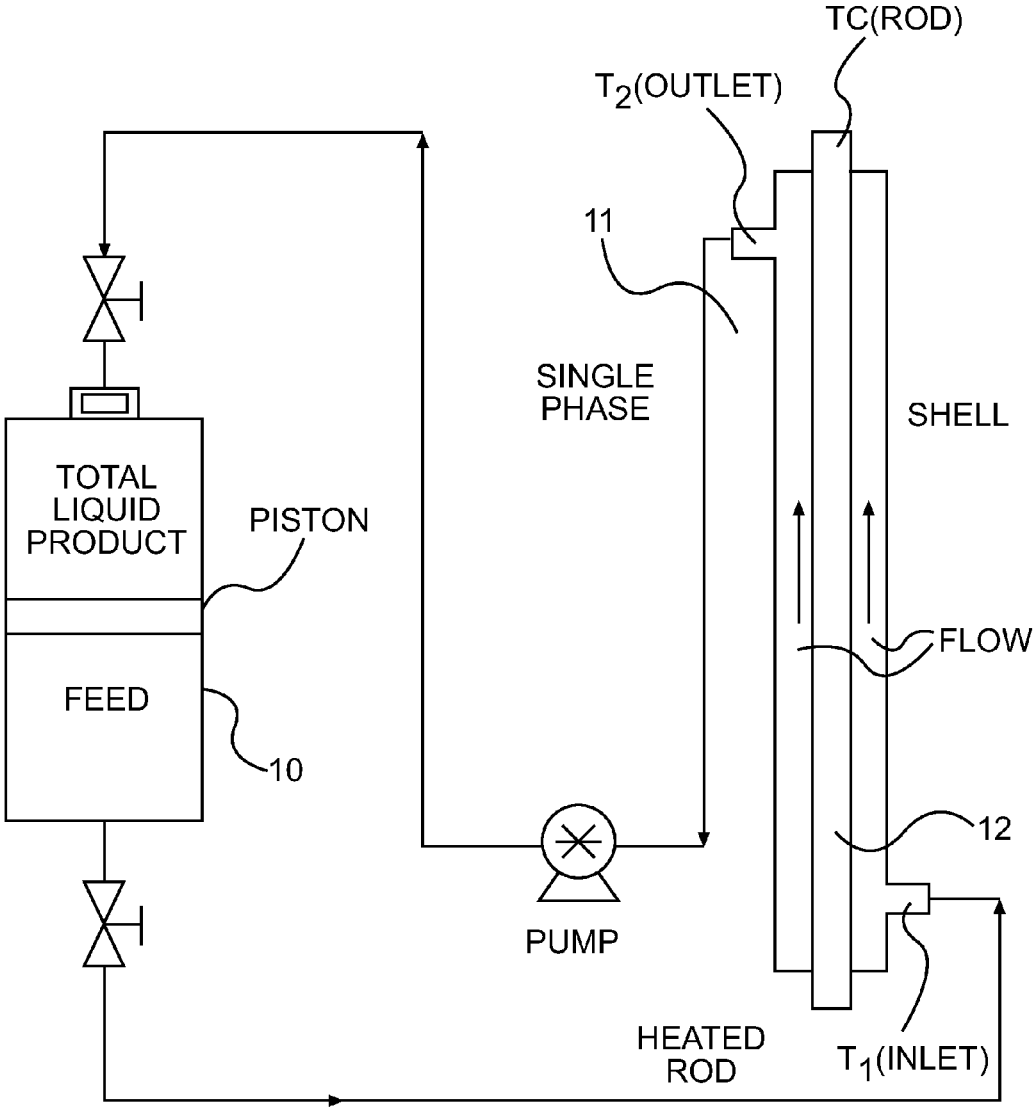
FIG. 1 is a schematic of an Alcor fouling simulator used in accordance with the present invention.
Figure 2:
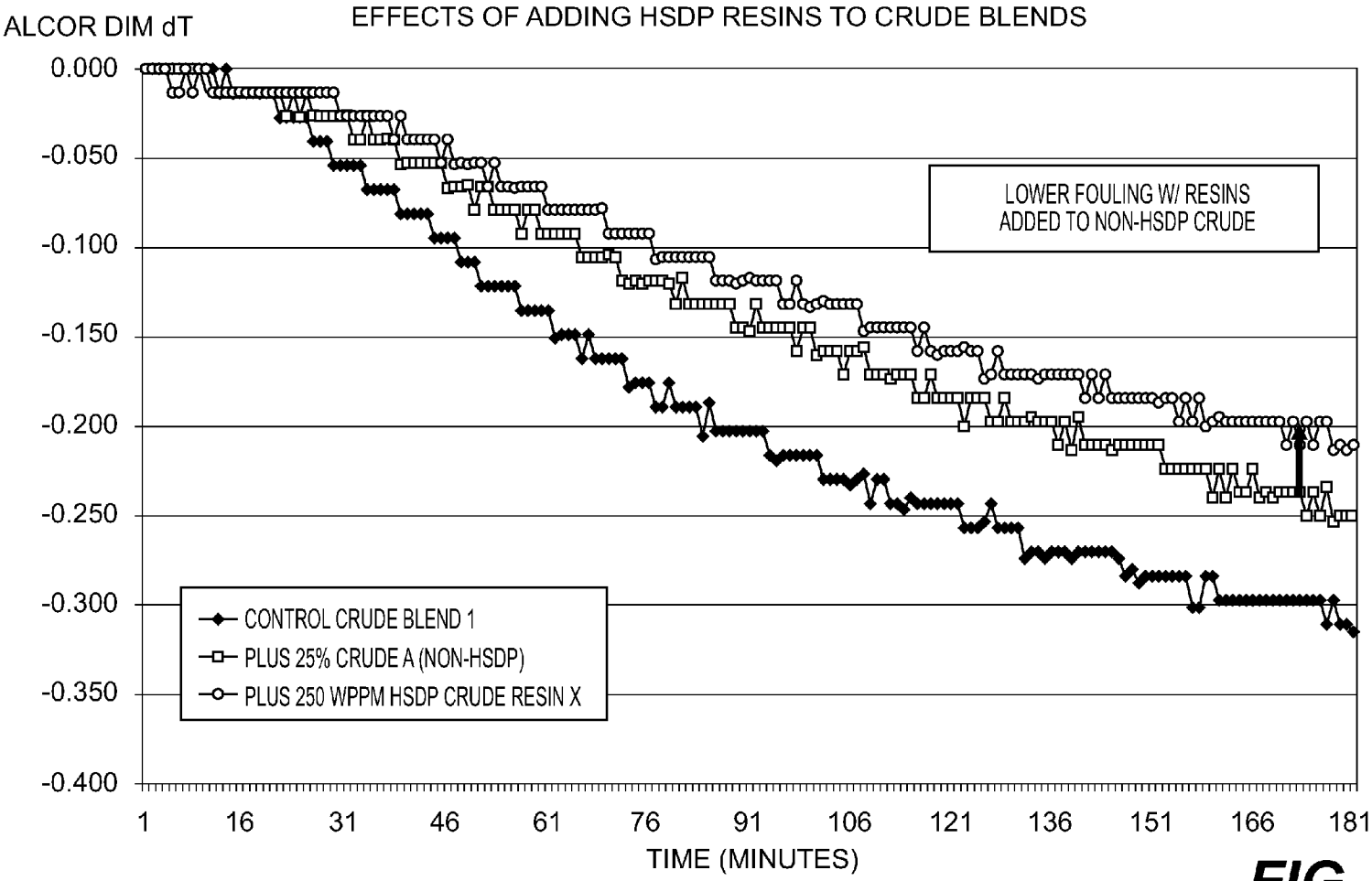
FIG. 2 is a graph illustrating the effects of adding HSDP resins to a non-HSDP crude oil, in accordance with one aspect of the present invention.

While the invention is capable of various modifications and alternative forms, specific embodiments thereof have been shown by way of the process diagrams and testing data shown in FIGS. 1-2, and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE INVENTION

Reference will now be made in detail to the various aspects of the present invention. The method and corresponding steps of the invention will be described in conjunction with the detailed description of the compositions and the drawings. Reference will be made to specific embodiments for purpose of illustration and not limitation.

Generally, the present invention aims to increase the fouling mitigation and on-line cleaning effects of a non-high solvency dispersive power (non-HSDP) crude oil, wherein the non-HSDP crude oil can act as a HSDP crude oil. This aim is achieved by a method of making a non-high solvency dispersive power (non-HSDP) crude oil with increased fouling mitigation and on-line cleaning effects. The non-HSDP crude oil includes a base non-HSDP crude oil and an effective amount of resins isolated from a high solvency dispersive power (HSDP) crude oil. Such a non-HSDP crude oil can be made in accordance with the present invention by providing a non-HSDP crude oil; providing resins isolated from a high solvency dispersive power (HSDP) crude oil; and blending the non-HSDP crude oil and an effective amount of the resins to form a blended crude oil.

Preferably, the non-HSDP crude oil has a solubility blending number ($S_{BN}$) less than about 90, and more preferably greater than about 55 and less than about 75. Selection of such "near-crudes" having a relatively high $S_{BN}$ improves the overall solvency of the asphaltenes in the crude blend according to Oil Compatibility Theory, but does not provide the full fouling mitigation and on-line cleaning effects of a HSDP crude oil.

The resins of the present invention can be isolated from the HSDP whole crude using any known techniques, such as those described in co-pending application Ser. No. 12/292,648, entitled "Methods Of Isolating And Using Components From A High Solvency Dispersive Power (HSDP) Crude Oil" filed on Nov. 24, 2008, the contents of which are incorporated herein in its entirety. Alternatively, a synthetic resin molecule can be used to transform the non-HSDP crude oil into a crude oil which functions as a HSDP crude oil with regard to fouling mitigation and on-line cleaning effects.

The effective amount of resins is preferably at least about 50 parts per million by weight (wppm), and more preferably between about 50 and 1000 parts per million by weight (wppm). Such low level additions of the HSDP resins increase the performance ability of "near-HSDP" crude oils by increasing the solvency and dispersant characteristics to levels that enable such "near-HSDP" crude oils to function as HSDP crude oil in terms of fouling mitigation and on-line cleaning effects.

The non-HSDP crude oil described herein can be used for reducing fouling in a crude oil refinery component, or even for on-line cleaning of a fouled crude oil refinery component. For example, and in accordance with one aspect of the invention, a method for reducing fouling in a crude oil refinery component is provided. The method includes providing a base crude oil; providing a non-high solvency dispersive power (non-HSDP) crude oil with increased fouling mitigation and on-line cleaning effects; blending the base crude oil with the non-HSDP crude oil with increased fouling mitigation and on-line cleaning effects to create a blended crude oil; and feeding the blended crude oil to a crude oil refinery component. The non-HSDP crude oil with increased fouling mitigation and on-line cleaning effects includes a non-HSDP crude oil and an effective amount of resins isolated from a high solvency dispersive power (HSDP) crude oil.

By contrast, an alternative method can be used for a fouled crude oil refinery component. On-line cleaning of a fouled crude oil refinery component provides that the component does not need to be removed from service and it is not necessary to re-route crude oil to other refinery components. The on-line method includes operating a fouled crude oil refinery component and feeding a blended crude oil to the fouled crude oil refinery component. The blended crude oil includes a base crude oil and a non-high solvency dispersive power (non-HSDP) crude oil with increased fouling mitigation and on-line cleaning effects. The non-HSDP crude oil with increased fouling mitigation and on-line cleaning effects includes a non-HSDP crude oil and an effective amount of resins isolated from a high solvency dispersive power (HSDP) crude oil.

Particularly, it has also been discovered to use non-HSDP crude oils with increased fouling mitigation and on-line cleaning effects to perform on-line cleaning of already fouled crude pre-heat train exchangers and other refinery components to improve heat transfer efficiencies and recovered furnace coil-inlet-temperatures (CITs). CIT levels of both atmospheric and vacuum pipestill furnaces have been found to increase dramatically when running non-HSDP crude oils with increased fouling mitigation and on-line cleaning effects, resulting in energy savings and environmental benefits as a result of reduced fired heating needs. As with co-blending for fouling mitigation, the on-line heat exchanger cleaning efficiency is dependent on the non-HSDP crude oil with increased fouling mitigation and on-line cleaning effects and its concentration. Fouled exchangers result in reduced furnace (atmospheric and vacuum) coil-inlet-temperatures (CITs), which requires additional firing resulting in increased energy demands and costs. The non-HSDP crude oils with increased fouling mitigation and on-line cleaning effects of the present invention have been shown to remove the foulant from already fouled refinery components. Addition of a non-HSDP crude oil with increased fouling mitigation and on-line cleaning effects to a fouled heat exchanger resulted in recovered CIT levels, thereby reducing the energy required to fire the furnace.

Blending of the base crude oil with the non-HSDP crude oil and feeding of the blended crude oil to a crude oil refinery component can be performed at and using any of a variety of known technologies which are standard in the blending of crude oils, such as batch mixing in tankage, including tankage on transport vessels such as oceanbound crude carriers, or continuous inline mixing in pipelines or other suitable vessels upstream of processing components.

In either method, the addition of non-HSDP crude oil with increased fouling mitigation and on-line cleaning effects mitigates both asphaltene induced fouling and particulate induced/promoted fouling. The somewhat high $S_{BN}$ of the non-HSDP crude oils in combination with resins isolated from a HSDP crude oil allows for the enhanced solubility of any asphaltenes in the rest of the crude oils and/or blends. The presence of TAN is believed to help disperse the particulates in the crude oil blend which prevents the particulates from adhering to the heated surface.

The volume of non-HSDP crude oil with increased fouling mitigation and on-line cleaning effects necessary in the blended crude oil will vary based upon the TAN and/or $S_{BN}$ values of the non-HSDP crude oil and the TAN and/or $S_{BN}$ values of the HSDP crude oil from which the resins are isolated. Generally, the higher TAN and/or $S_{BN}$ values of the non-HSDP crude oil and HSDP crude oil resins, the lower the volume of non-HSDP crude oil with increased fouling mitigation and on-line cleaning effects necessary to produce a blended crude oil that will reduce and/or mitigate both asphaltene induced fouling and particulate induced fouling and/or promotion in refinery components, including but not limited to heat exchangers. For example, the crude oil refinery component can be a heat exchanger, furnace, distillation column, scrubber, reactor, liquid-jacketed tank, pipestill, coker, a visbreaker, or any other suitable component.

The base crude oil can be a whole crude oil or a blend of at least two crude oils. The non-HSDP crude oil with increased fouling mitigation and on-line cleaning effects preferably makes up between five percent and fifty percent of the total volume of the blended crude oil.

The blended crude oil including the non-HSDP crude oil with increased fouling mitigation and on-line cleaning effects is then processed within the refinery. This blended crude oil exhibits improved characteristics over the base crude oil. Specifically, the blended crude oil exhibits a significant reduction in fouling over base crude which contain particulates. This results in improved heat transfer within the crude oil refinery component, and a reduction in overall energy consumption.

For the purpose of illustration, and not limitation, FIG. 1 depicts an Alcor testing arrangement used to measure what the impact the addition of a non-HSDP crude oil with increased fouling mitigation and on-line cleaning effects has on the reduction and mitigation of fouling. The testing arrangement includes a reservoir 10 containing a feed supply of crude oil. The feed supply of crude oil can contain a base crude oil containing a whole crude or a blended crude containing two or more crude oils. The feed supply can also contain a non-HSDP crude oil with increased fouling mitigation and on-line cleaning effects, or the non-HSDP crude oil can be introduced downstream in the system at a suitable location using known techniques. The feed supply is heated to a temperature of approximately 150° C./302° F. and then fed into a shell 11 containing a vertically oriented heated rod 12. The heated rod 12 can be formed from a carbon steel. The heated rod 12 simulates a tube in a heat exchanger. The heated rod 12 is electrically heated to a predetermined temperature and maintained at such predetermined temperature during the trial. Typically rod surface temperatures are approximately 370° C./698° F. and 400° C./752° F. The feed supply is pumped across the heated rod 12 at a flow rate of approximately 3.0 mL/minute. The spent feed supply is collected in the top section of the reservoir 10. The spent feed supply is separated from the untreated feed supply oil by a sealed piston, thereby allowing for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface. The foulant deposits are thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid ΔT or ΔT and can be dependent on the type of crude oil/blend, testing conditions and/or other effects, such as the presence of salts, sediment or other fouling promoting materials. A standard Alcor fouling test is carried out for 180 minutes. The total fouling, as measured by the total reduction in outlet liquid temperature is referred to as ΔT180 or dT180.

The presence of particulates in a crude oil has an impact on fouling of a refinery component or unit. There is an increase in fouling in the presence of iron oxide ($Fe_2O_3$) particles when compared to similar crude oils that do not contain particulates. It is intended that the present invention has application with all whole and blended crude oils and formulations of the same that experience and/or produce fouling in refinery components including but not limited to heat exchangers. The presence of fouling reduces the heat transfer of the heating tubes or rods contained within a heat exchanger. As described above, the presence of fouling has an adverse impact of heat exchanger performance and efficiency.

It has been demonstrated that the addition of a non-HSDP with increased fouling mitigation and on-line cleaning effects to a fouling crude oil blend reduces particulate fouling when compared to a control group. A sample test was performed to determine the effect the addition of a non-HSDP crude oils with increased fouling mitigation and on-line cleaning effects with a base crude oil has on the fouling of the base oil. The results are illustrated in FIG. 2. The reduction in fouling of the initial control blend due to the addition of 25% non-HSDP (non-fouling) crude oil is approximately 20%. The reduction in fouling is increased to 33% when an addition of 25% non-HSDP crude oil with 250 wppm of resins isolated from a HSDP crude oil is blended with the base crude.

The results demonstrate that addition of ppm of resins isolated from a HSDP crude oil to a non-HSDP crude oil before blending with a base oil increases the fouling mitigation effects of the non-HSDP crude oil. The above illustrative example of the benefits of the present invention is not intended to limit the present invention.

As described above, and in accordance with another aspect of the present invention, a system is provided that is capable of experiencing fouling conditions associated with particulate or asphaltene fouling. The system generally includes at least one crude oil refinery component and a blend in fluid communication with the at least one crude oil refinery component. The blend includes a base crude oil and a non-high solvency dispersive power (non-HSDP) crude oil with increased fouling mitigation and on-line cleaning effects. The non-HSDP crude oil with increased fouling mitigation and on-line cleaning effects includes a non-HSDP crude oil and an effective amount of resins isolated from a high solvency dispersive power (HSDP) crude oil.

As noted above, the base crude oil can be a whole crude oil or a blend of at least two crude oils. The crude oil refinery component can be a heat exchanger, furnace, distillation column, scrubber, reactor, liquid-jacketed tank, pipestill, coker, a visbreaker, or other suitable components.

It will be apparent to those skilled in the art that various modifications and/or variations can be made without departing from the scope of the present invention. It is intended that all matter contained in the accompanying specification shall be interpreted as illustrative only and not in a limiting sense. While the present invention has been described in the context of the heat exchanger in a refinery operation, the present invention is not intended to be so limited; rather it is contemplated that the present invention is suitable for reducing and/or mitigating fouling in other refinery components including but not limited to pipestills, cokers, visbreakers and the like.

Furthermore, it is contemplated that the use of a non-HSDP crude oil with increased fouling mitigation and on-line cleaning effects, as described in connection with the present invention, can be combined with other techniques for reducing and/or mitigating fouling. Such techniques include, but are not limited to, (i) the provision of low energy surfaces and modified steel surfaces in heat exchanger tubes, as described in U.S. patent application Ser. Nos. 11/436,602 (U.S. Pat. No. 7,823,627) and 11/436,802 (U.S. Pat. No. 8,201,619), the disclosures of which are incorporated herein specifically by reference; (ii) the use of controlled mechanical vibration, as described in U.S. patent application Ser. No. 11/436,802, the disclosure of which is incorporated herein specifically by reference; (iii) the use of fluid pulsation and/or vibration, which can be combined with surface coatings, as described in U.S. patent application Ser. No. 11/802,617, (now abandoned) filed on Jun. 19, 2007, entitled "Reduction of Fouling in Heat Exchangers," the disclosure of which is incorporated herein specifically by reference; (iv) the use of electropolishing on heat exchanger tubes and/or surface coatings and/or modifications, as described in U.S. patent application Ser. No. 11/641,754(U.S. Pat. No. 8,201,619), the disclosure of which is incorporated herein specifically by reference; and (v) combinations of the same, as described in U.S. patent application Ser. No. 11/641,755 (now abandoned), filed on Dec. 20, 2006, entitled "A Method of Reducing Heat Exchanger Fouling in a Refinery," the disclosure of which is incorporated herein specifically by reference. Thus, it is intended that the present invention covers the modifications and variations of the method herein, provided they come within the scope of the appended claims and their equivalents.

While a particular form of the invention has been described, it will be apparent to those skilled in the art that various modifications can be made without departing from the spirit and scope of the invention.

Accordingly, it is not intended that the invention be limited except by the appended claims. While the present invention has been described with reference to one or more particular embodiments, those skilled in the art will recognize that many changes can be made thereto without departing from the spirit and scope of the present invention. Each of these embodiments and obvious variations thereof is contemplated as falling within the spirit and scope of the claimed invention, which is set forth in the following claims.

What is claimed is:

1. A method of making a non-high solvency dispersive power (non-HSDP) crude oil with increased fouling mitigation and on-line cleaning effects, comprising:
- providing a non-HSDP crude oil;
- providing resins isolated from a high solvency dispersive power (HSDP) crude oil; and
- blending the non-HSDP crude oil and an effective amount of the resins to form a blended crude oil, wherein the effective amount of resins is between about 50 and 1000 parts per million by weight (wppm).

2. The method of claim 1, wherein the non-HSDP crude oil has a solubility blending number ($S_{BN}$) less than about 90.

3. The method of claim 2, wherein the non-HSDP crude oil has a solubility blending number ($S_{BN}$) greater than about 55 and less than about 75.

4. A non-high solvency dispersive power (non-HSDP) crude oil with increased fouling mitigation and on-line cleaning effects, comprising:
- a base non-HSDP crude oil; and
- an effective amount of resins isolated from a high solvency dispersive power (HSDP) crude oil, wherein the effective amount of resins is between about 50 and 1000 parts million by weight (wppm).

5. The non-HSDP crude oil of claim 4, wherein the base non-HSDP crude oil has a solubility blending number ($S_{BN}$) less than about 90.

6. The non-HSDP crude oil of claim 5, wherein the base non-HSDP crude oil has a solubility blending number ($S_{BN}$) greater than about 55 and less than about 75.

7. The non-HSDP crude oil of claim 4, wherein the base non-HSDP crude oil is one of a whole crude oil or a blend of at least two crude oils.

8. A system capable of experiencing fouling conditions associated with particulate or asphaltene fouling, comprising:
- at least one crude oil refinery component; and
- a blend in fluid communication with the at least one crude oil refinery component, the blend including a base crude oil and a non-high solvency dispersive power (non-HSDP) crude oil with increased fouling mitigation and on-line cleaning effects, wherein the non-HSDP crude oil with increased fouling mitigation and on-line cleaning effects comprises:
  - a non-HSDP crude oil; and
  - an effective amount of resins isolated from a high solvency dispersive power (HSDP) crude oil.

9. The system of claim 8, wherein the non-HSDP crude oil has a solubility blending number ($S_{BN}$) less than about 90.

10. The system of claim 9, wherein the non-HSDP crude oil has a solubility blending number ($S_{BN}$) greater than about 55 and less than about 75.

11. The system of claim 8, wherein the effective amount of resins is at least about 50 parts per million by weight (wppm).

12. The system of claim 11, wherein the effective amount of resins is between about 50 and 1000 parts per million by weight (wppm).

13. The system of claim 8, wherein the base crude oil is one of a whole crude oil or a blend of at least two crude oils.

14. The system of claim 8, wherein the at least one crude oil refinery component is selected from a heat exchanger, furnace, distillation column, scrubber, reactor, liquid-jacketed tank, pipestill, coker, and visbreaker.

15. The system of claim 14, wherein the at least one crude oil refinery component is a heat exchanger.

16. The system according to claim 8, wherein the non-high solvency dispersive power crude oil is between 5 and 50 percent of the total volume of the blended crude oil.

17. A method for on-line cleaning of a fouled crude oil refinery component, comprising:
- operating a fouled crude oil refinery component; and
- feeding a blended crude oil to the fouled crude oil refinery component, the blended crude oil comprising a blend of:
  - a base crude oil; and
  - a non-high solvency dispersive power (non-HSDP) crude oil with increased fouling mitigation and on-line cleaning effects, wherein the non-HSDP crude oil with increased fouling mitigation and on-line cleaning effects comprises:
    - a non-HSDP crude oil; and
    - an effective amount of resins isolated from a high solvency dispersive power (HSDP) crude oil.

18. The method according to claim 17, wherein the effective amount of resins is at least about 50 parts per million by weight (wppm).

19. The method according to claim 18, wherein the effective amount of resins is between about 50 and 1000 parts per million by weight (wppm).

20. The method according to claim 17, wherein the non-HSDP crude oil has a solubility blending number ($S_{BN}$) less than about 90.

21. The method according to claim 20, wherein the non-HSDP crude oil has a solubility blending number ($S_{BN}$) greater than about 55 and less than about 75.

22. The method according to claim 17, wherein the base crude oil is one of a whole crude oil or a blend of at least two crude oils.

23. The method according to claim 17, wherein the crude oil refinery component is selected from: heat exchanger, furnace, distillation column, scrubber, reactor, liquid-jacketed tank, pipestill, coker, and visbreaker.

24. The method according to claim 17, wherein the non-high solvency dispersive power crude oil is between 5 and 50 percent of the total volume of the blended crude oil.

25. A method for reducing fouling in a crude oil refinery component, comprising:

providing a base crude oil;

providing a non-high solvency dispersive power (non-HSDP) crude oil with increased fouling mitigation and on-line cleaning effects, wherein the non-HSDP crude oil with increased fouling mitigation and on-line cleaning effects comprises:

a non-HSDP crude oil; and an effective amount of resins isolated from a high solvency dispersive power (HSDP) crude oil;

blending the base crude oil with the non-HSDP crude oil with increased fouling mitigation and on-line cleaning effects to create a blended crude oil; and feeding the blended crude oil to a crude oil refinery component.

26. The method according to claim 25, wherein the effective amount of resins is at least about 50 parts per million by weight (wppm).

27. The method according to claim 26, wherein the effective amount of resins is between about 50 and 1000 parts per million by weight (wppm).

28. The method according to claim 25, wherein the non-HSDP crude oil has a solubility blending number ($S_{BN}$) less than about 90.

29. The method according to claim 28, wherein the non-HSDP crude oil has a solubility blending number ($S_{BN}$) greater than about 55 and less than about 75.

30. The method according to claim 25, wherein the base crude oil is one of a whole crude oil or a blend of at least two crude oils.

31. The method according to claim 25, wherein the crude oil refinery component is selected from: heat exchanger, furnace, distillation column, scrubber, reactor, liquid-jacketed tank, pipestill, coker, and visbreaker.

32. The method according to claim 25, wherein the non-high solvency dispersive power crude oil is between 5 and 50 percent of the total volume of the blended crude oil.

* * * * *